US008267740B1

(12) United States Patent
Afxentiou

(10) Patent No.: US 8,267,740 B1
(45) Date of Patent: Sep. 18, 2012

(54) ASYMMETRICAL BOSOM CORRECTIVE BRASSIERE

(76) Inventor: Claudia Afxentiou, Oakland Gardens, NY (US)

( * ) Notice: Subject to any disclaimer, the term of this patent is extended or adjusted under 35 U.S.C. 154(b) by 0 days.

(21) Appl. No.: 12/802,269

(22) Filed: Jun. 4, 2010

Related U.S. Application Data

(60) Provisional application No. 61/270,823, filed on Jul. 15, 2009.

(51) Int. Cl.
*A41C 3/00* (2006.01)

(52) U.S. Cl. ..... 450/86; 450/63; 450/65; 450/76

(58) Field of Classification Search ..... 450/1, 86, 450/63, 65, 76
See application file for complete search history.

(56) References Cited

U.S. PATENT DOCUMENTS

| | | | | | |
|---|---|---|---|---|---|
| 4,640,287 | A * | 2/1987 | Anderson et al. | ..... | 450/36 |
| 4,781,651 | A * | 11/1988 | Ekins | ..... | 450/79 |
| 5,152,741 | A * | 10/1992 | Farnio | ..... | 602/79 |
| 5,429,593 | A * | 7/1995 | Matory | ..... | 602/79 |
| 5,538,502 | A * | 7/1996 | Johnstone | ..... | 602/79 |
| 5,951,364 | A * | 9/1999 | Brown et al. | ..... | 450/1 |
| 6,165,045 | A * | 12/2000 | Miller et al. | ..... | 450/1 |
| 6,200,194 | B1 * | 3/2001 | Grier | ..... | 450/64 |
| 6,319,091 | B1 * | 11/2001 | Kilbride et al. | ..... | 450/17 |
| 7,001,240 | B1 * | 2/2006 | Huffman-Jimenez | ..... | 450/58 |
| 7,163,432 | B2 * | 1/2007 | Mitchell et al. | ..... | 450/65 |

* cited by examiner

*Primary Examiner* — Gloria Hale
(74) *Attorney, Agent, or Firm* — Galgano & Associates, PLLC; Thomas M. Galgano; Jessica G. Bower

(57) ABSTRACT

An anomaly-correcting brassiere of assumed positions of asymmetrical bosoms using interconnecting patches of Velcro loops and hooks for shoulder straps constituted as closed loops and non-elastic construction material to maintain symmetrical and obviate asymmetrical bosom conditions.

1 Claim, 3 Drawing Sheets

ASYMMETRICAL BOSOM CORRECTIVE BRASSIERE

The present invention relates generally to improvements for a brassiere for a female having cognizable asymmetric bosoms, and more particularly to improvements whereby the bosom's lower breast cup is urged in ascending movement as a result of its shoulder strap size adjustment to contribute to the brassiere cup-supported breasts being oriented in horizontal relation during wearing use of the brassiere, all as will be better understood as the description proceeds.

BACKGROUND OF THE INVENTION

Field of Search

Exemplified by U.S. Pat. No. 5,152,741 issued to the patentee Farnio, but prevalent in many patents too numerous to mention, is the practice of using stretchable brassiere shoulder straps for the wearing comfort of the user during movement, and also in the sizing of the brassiere in conjunction with brassiere cup sizes.

As is known to occur in normal growth, a right-handed individual's right arm is larger than the left, and like anatomical situations exist, and so also is a condition in which, as noted, a female's bosoms are noticeably not in a horizontal alignment with each other to the significant embarrassment of the wearer.

SUMMARY OF THE INVENTION

Broadly, it is an object of the present invention to overcome the foregoing and other noted difficulties of the prior art.

More particularly, it is an object to provide a non-elastic shoulder strap and a size-adjustment made thereof to allay the embarrassment of the brassiere wearer.

BRIEF DESCRIPTION OF SEVERAL VIEWS OF THE DRAWING

The description of the invention which follows, together with the accompanying drawing should not be construed as limiting the invention to the example shown and described, because those skilled in the art to which this invention appertains will be able to devise other forms thereof.

DETAILED DESCRIPTION OF THE INVENTION

Figure 2:
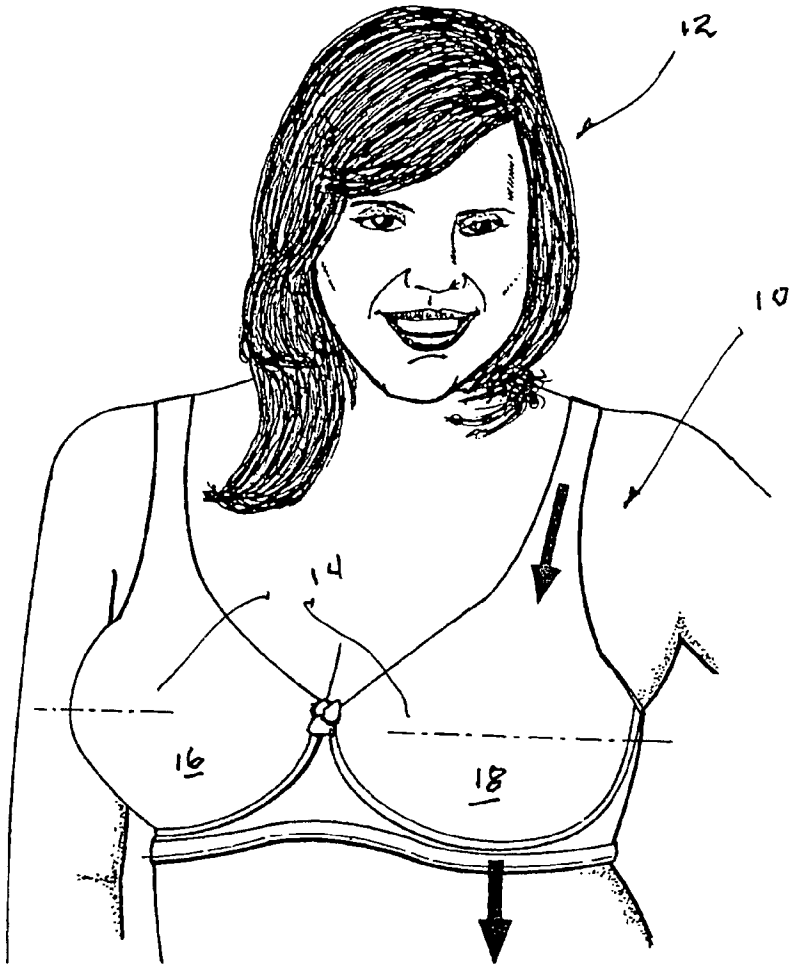
FIGS. 1 and 2 are prior art-labeled front elevational views of a brassiere-wearing female in which in FIG. 1 the anomaly of an asymmetrical bosom is illustrated and in which, in FIG. 2, it is illustrated that the anomaly persists wearing a brassiere of the prior art.
Figure 1:
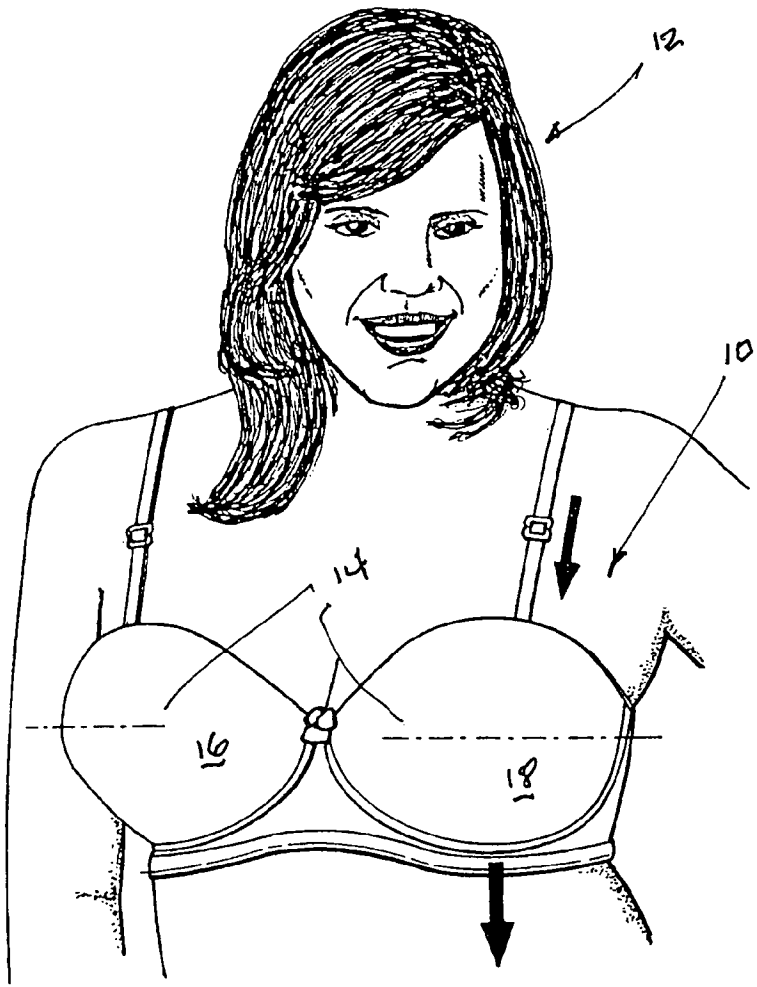

Shown in the drawings is a brassiere, generally designated 10, to be used by a female 12 having, as often occurs, an asymmetrical bosom 14 in which the left breast 16 and right breast 18 are not horizontally positioned adjacent each other, it being assumed in this case that the right breast 18 is lower than the left breast 16 by a half inch or so, an anomaly known to the female 12 to an extent that she requires correction to be effectuated during the wearing of the brassiere 10.

Figure 3:
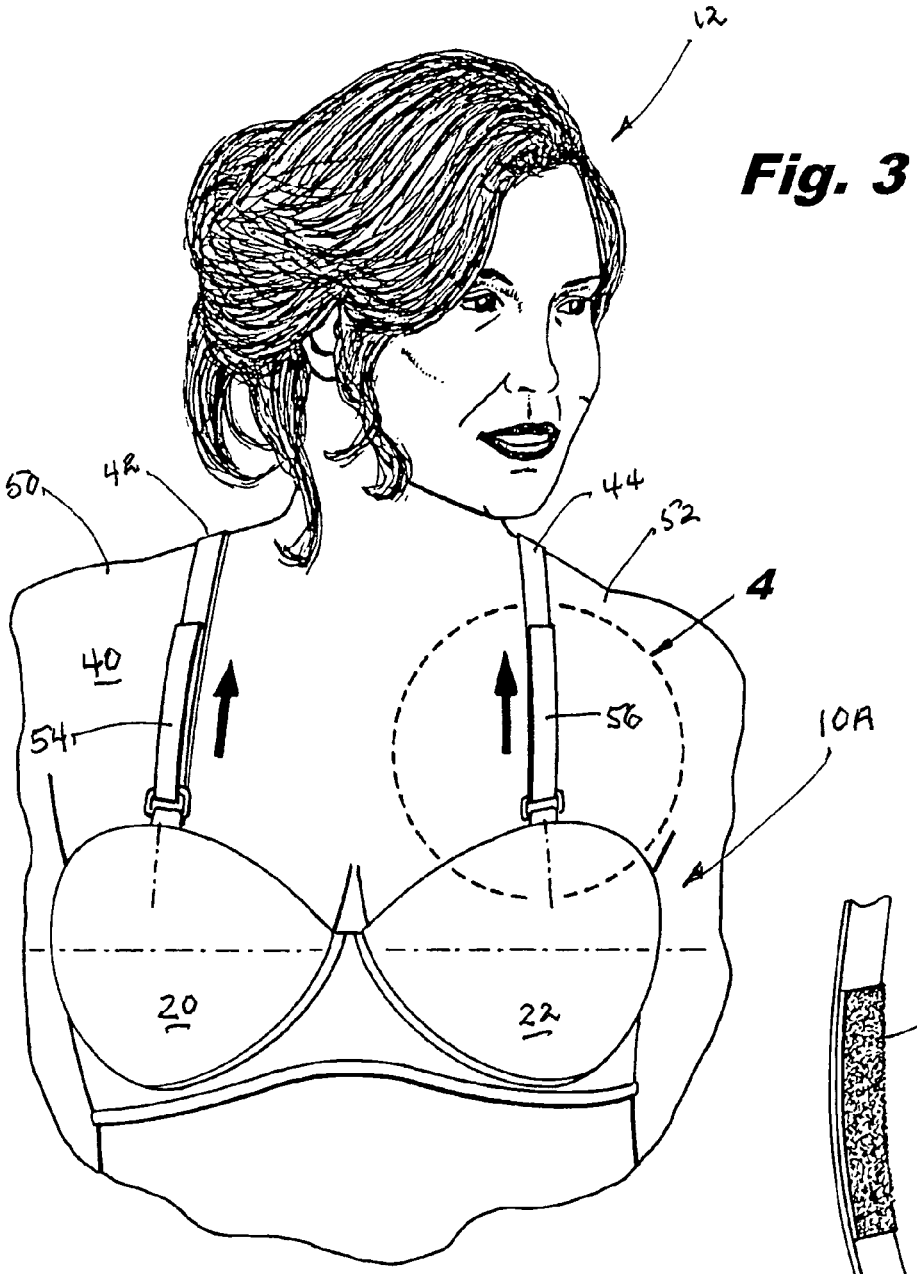
FIG. 3 is a front elevational view of said brassiere-wearing female having a corrected symmetrical bosom wearing the inventive brassiere according to the present invention.
Figure 4:
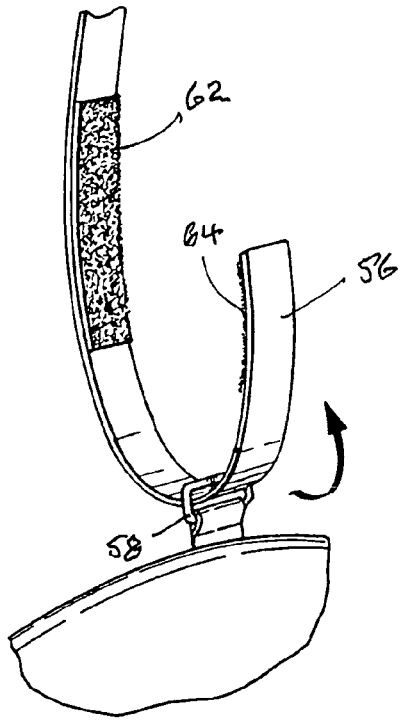
FIG. 4 is a partial perspective view of the structural features in the area designated by the arrow 4 in FIG. 3.
Figure 5:
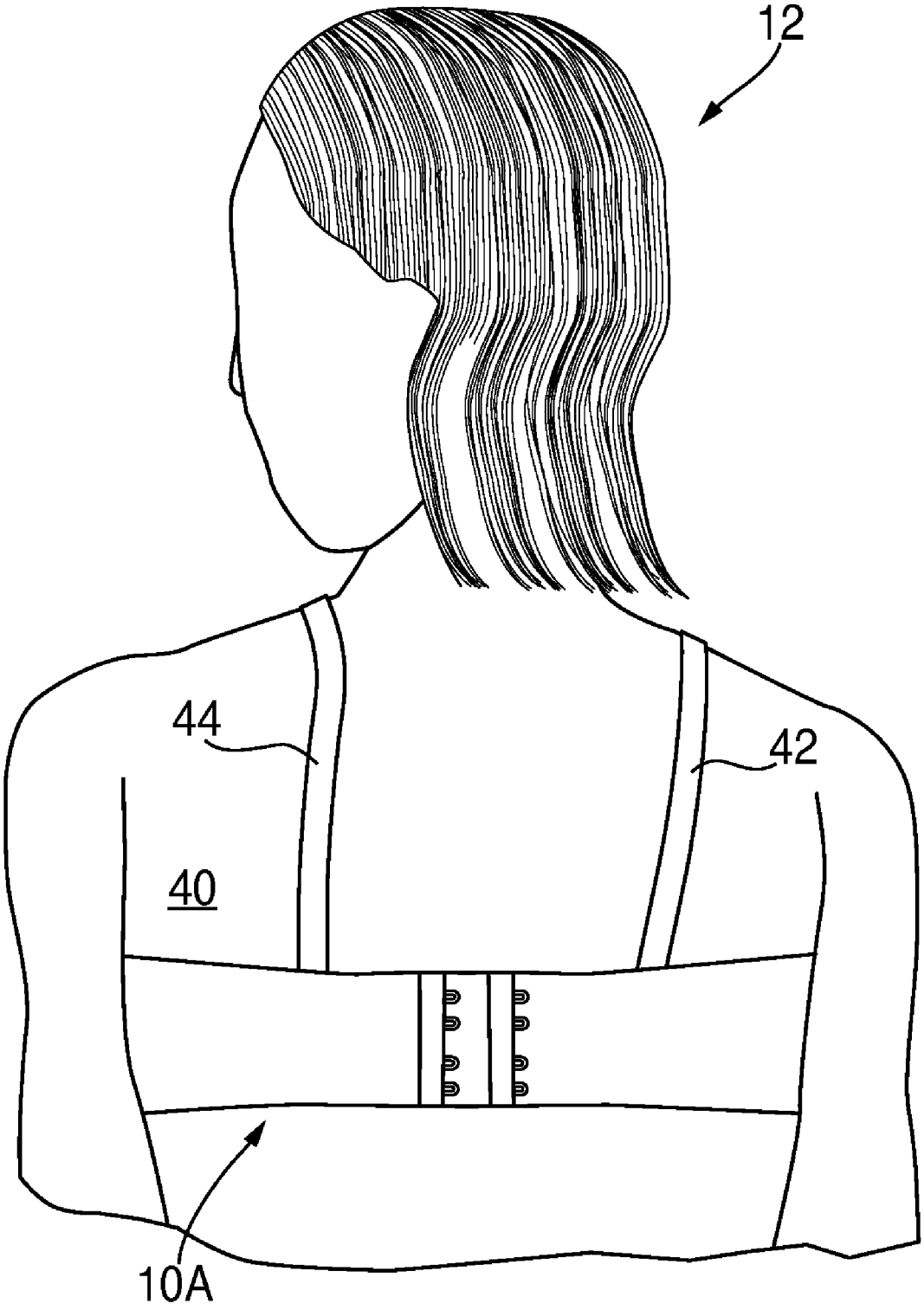
FIG. 5 is a rear elevational view of said brassiere-wearing female wearing the brassiere according to the present invention.

To achieve the purposes intended (see FIG. 3), brassiere 10A has cooperating left and right breast-covering brassiere cups 20 and 22 and two selected lengths, as known from common experience, of cooperating back straps of elastic construction material and each attached to extend from opposite sides of a cooperating brassiere cup into connected relation to each other rearwardly of the female 12, as seen in FIG. 5.

Consequently, there is an urgency in the elastic construction material which maintains the brassiere 10A in encircling relation about the upper torso 40 of the female 12.

Completing the construction of the brassiere 10A are a left 42 and a right 44 shoulder strap of selected construction material, as subsequently disclosed, which straps 42, 44 are attached, as at rear torso sites to extend therefrom forwardly over cooperating shoulders 50, 52 and present free ends 54, 56 threaded through cup-attached loop-shaped links 58.

Patches of loops 62 and hooks 64 in facing relation to each other are adhesively attached to the free ends 54, 56 so that during the wearing of the brassiere 10A the shoulder straps 42, 44 are configurated as closed loops.

Underlying the present invention is the selection of non-elastic construction material for the shoulder straps 42, 44 so that a selected closed-loop for the sagging or lower breast 18 having undergone a size adjustment to raise the breast 18 from an asymmetrical into a symmetrical relation of the female's bosom 14 is maintained during the wearing of the brassiere 10.

While the construction and operating mode of the within inventive corrective brassiere herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A brassiere for a female having an asymmetrical bosom constituted of a right and left breast, comprising:

left and right breast-covering brassiere cups, each having a top edge and inner and outer side edges;

two cup-attached loop-shaped links, one of which is attached to said top edge of said left brassiere cup, at a position spaced-apart and disposed above said top edge thereof and substantially centrally disposed between said inner and outer side edges thereof and the other of which is attached to said top edge of said right brassiere cup, at a position spaced-apart and disposed above said top edge thereof and substantially centrally disposed between said inner and outer side edges thereof;

a central connector being disposed between and connected to said inner side edges of said left and right brassiere cups;

two predetermined lengths of interconnectable back straps each constructed of elastic material, each of said back straps having one end connected to said outer edge of one of said brassiere cups and an opposite end for interconnection with the other of said back straps rearwardly of the female, so that the interconnection of said back straps is effective to maintain said brassiere in wearing relation on an upper torso of the female;

a left and right shoulder strap, constructed of a non-elastic material, each having one end attached to extend from said interconnectable back straps forwardly over the shoulder of the female and having a second free end threaded through said cup-attached loop-shaped links to overlie a portion of said strap; and loop and hook fasteners releasably attached in facing relation to each other on said overlying portion of said left and right shoulder straps, forming closeable loops therefrom;

wherein the lengths of said left and right shoulder straps are separately adjustable to a predetermined length via said loops and hooks and wherein, the adjustment of which, in turn, urges the female's breast in ascending movement in order to adjust the female's asymmetrical bosom.

* * * * *